United States Patent [19]

Hodges

[11] 3,998,018

[45] Dec. 21, 1976

[54] WALL PANEL MOUNTING SYSTEM

[75] Inventor: Jack D. Hodges, Oakland, Calif.

[73] Assignee: Kaiser Cement & Gypsum Corporation, Oakland, Calif.

[22] Filed: Mar. 31, 1975

[21] Appl. No.: 563,584

[52] U.S. Cl. ..... 52/481; 52/363; 52/489; 52/511

[51] Int. Cl.[2] ..... E04B 2/76; E04B 2/82

[58] Field of Search ..... 52/482, 483, 354, 497, 52/355, 511, 359, 360, 281, 481, 243, 488, 489, 363

[56] References Cited

UNITED STATES PATENTS

| | | | |
|---|---|---|---|
| 1,974,819 | 9/1934 | Koerner | 52/481 |
| 2,066,814 | 1/1937 | Williams | 52/363 |
| 2,616,142 | 11/1952 | Tinnerman | 52/511 X |
| 2,924,856 | 2/1960 | Price | 52/483 X |
| 3,094,201 | 6/1963 | Williams | 52/355 X |
| 3,256,666 | 6/1966 | Farmer | 52/481 |
| 3,308,590 | 3/1967 | Ettore et al. | 52/509 X |
| 3,522,923 | 8/1970 | Charpenter | 52/483 X |
| 3,608,266 | 9/1971 | Satkin et al. | 52/511 X |
| 3,705,471 | 12/1972 | Allen | 52/483 X |
| 3,722,163 | 3/1973 | Satkin et al. | 52/511 X |
| 3,753,325 | 8/1973 | Stanley et al. | 52/481 |
| 3,862,530 | 1/1975 | Martine | 52/489 X |
| 3,900,996 | 8/1975 | Yohe | 52/489 X |

FOREIGN PATENTS OR APPLICATIONS

| | | | |
|---|---|---|---|
| 658,374 | 10/1951 | United Kingdom | 52/489 |
| 1,037,172 | 7/1966 | United Kingdom | 52/489 |

*Primary Examiner*—Price C. Faw, Jr.
*Assistant Examiner*—Leslie Braun
*Attorney, Agent, or Firm*—Naylor, Neal & Uilkema

[57] ABSTRACT

A system for forming a building partition wherein wall panels are secured to opposite sides of vertically extending studs. A metal base member capable of rapid attachment to the edge of a wall panel which base member defines a clip supporting slot. A clip slidably engageable in the slot at divers horizontal positions therealong so that the panels can be attached to studs notwithstanding minor differences in widths of the panels. The clip and the stud cooperate so that the panels can be removed without destruction of the panel, if such becomes necessary during relocation of a partition.

11 Claims, 11 Drawing Figures

WALL PANEL MOUNTING SYSTEM

BACKGROUND OF THE INVENTION

This invention relates to a building partition and, more particularly, to apparatus for attaching wall panels, such as gypsum board panels, to studs so that minor variations in panel width can be accommodated.

U.S. Pat. No. 2,097,988 discloses a wall construction that requires installation of horizontal members to the studs. Clips fastened to the rear surface of a wall panel engage the horizontal members. H-shaped strips are required to maintain adjacent wall panels in alignment.

No other known prior art discloses panel mounting apparatus in a stud wall that affords the adjustability afforded by the present invention, which adjustability is most desirable in accommodating for minor variations in panel width. The known prior art considered most pertinent is evidenced by the following U.S. Pat. Nos.: 2,048,981; 3,312,030; 3,686,810; 3,705,471; and, 3,753,325.

The prior art, as exemplified in above cited U.S. Pat. Nos. 3,686,810 and 3,705,471, discloses a panel attaching apparatus which includes a fastening strip to be laminated, such as by employment of an adhesive, to the rear surface of a wall panel. Not only is this prior art technique expensive, but the lamination is typically done at a factory, with the result that the panels, when shipped, have projections which can damage surfaces of adjacent panels. Additionally, the laminated strips are not arranged to afford any degree of adjustment to accommodate panels of slightly varying widths to a partition or wall.

SUMMARY OF THE INVENTION

A partition composed of vertically extending metal studs on opposite surfaces of which are fastened gypsum board panels is a widely used structure, particularly in office buildings where a large plurality of relatively temporary, non-load bearing partitions are required. The high cost of labor for installing the partitions and the desirability of reusing materials when a partition is relocated have led to the development of gypsum panels covered with decorative and durable layers of vinyl and the like. Panels of this type are, typically, installed without taping the joints between abutting panels so as to be compatible with the economic factors enumerated above. An object of the present invention is to provide an improved wall system that achieves the stated advantages at a lower cost, both in materials and in labor, than prior art systems.

A more specific object of the invention is to provide panel mounting apparatus that can be quickly fastened to the rear surface of the panels on the job without employment of special tools. By achieving this object, the present invention permits panels to be shipped from the factory to the job site in a smooth flat condition and without any projections such as would mar or otherwise adversely affect the panels and their decorative surface. This object is achieved by providing a base member, preferably constructed of resilient sheet steel, which can be installed on the edge of the panel without employing adhesives or any specialized tools.

Another object is to provide a panel mounting system which can accommodate minor variations in the width of the panels employed in forming a partition. Achievement of this object is important because in the mass production of wall panels, be they gypsum board panels or panels made of other material, tolerances within about plus or minus 1/16 of an inch of the nominal panel width are typical. Thus, if a two-sided partition, having a length of say ten panels is erected, studs which are properly located to effect mounting of panels on one side wall not necessarily be properly aligned for supporting the panels on the other side. This object is achieved by providing a base member and clip assembly which can be installed in the field and which affords a degree of horizontal movement between the base member and the clip to accommodate for variations in panel width. Thus, the clips can be attached to the stud with edges of adjacent panels in tightly fitting abutting relationship, notwithstanding such width variations.

A further object of the present invention is to provide a partition system which permits the various parts, i.e., panels, studs, and fastening hardware to be shipped to the job site separately.

The foregoing, together with other objects, features and advantages of the invention will be more apparent after referring to the following specification and the accompanying drawings.

BRIEF DESCRIPTION OF THE DRAWINGS

FIG. 6 is an exploded isometric view of the fastener of the invention in relation to a stud constructed according to the invention.

DESCRIPTION OF THE PREFERRED EMBODIMENTS

Figure 1:
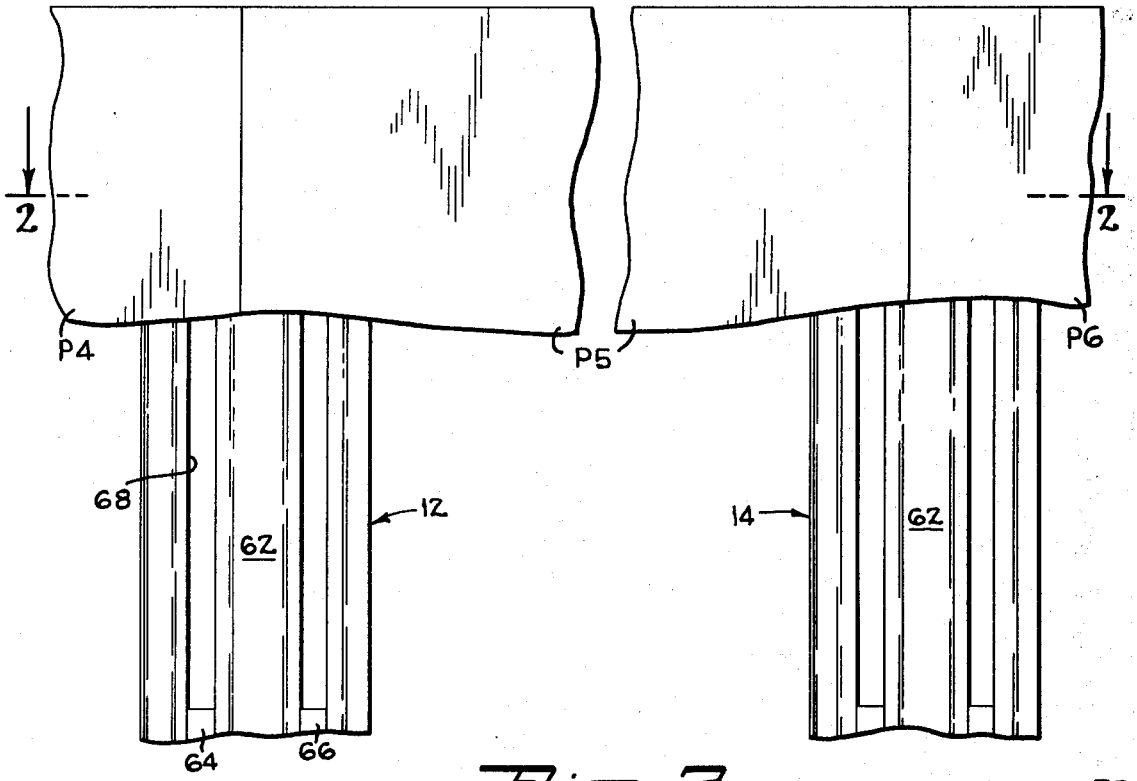
FIG. 1 is a fragmentary elevational view of one side of a partition embodying the present invention, a portion being broken away to reveal internal details.

Referring more particularly to the drawings and to the embodiment of FIGS. 1–6, reference characters $P_1$, $P_2$, $P_3$, $P_4$, $P_5$ and $P_6$ indicate wall panels, such as gypsum board wall panels, that have a core C and a face skin S. Face skin S can be the conventional paper, plastic, vinyl, wood veneer, or the like. Panels $P_1$ through $P_6$ are supported on spaced apart vertically extending studs, two of which are seen at 12 and 14. The upper and lower extremities of the studs are supported in accordance with any suitable expedient such as a U-shaped or J-shaped track into which the studs fit, or a U-shaped track into which studs and panels fit.

The studs are typically installed at center lines 16 and 18 which center lines are spaced from one another by a distance corresponding to the nominal width of panels $P_1$–$P_6$. It is not necessary that the upper and lower extremities of studs 12 and 14 be fixed since, as will appear, they both receive support from and provide support for the panels.

For securing the panels to the studs, the present invention provides a plurality of two part fasteners, one part of which is a base member 20. As can be seen most clearly in FIGS. 2, 3 and 4, the base member is a U-shaped sheet metal member so bent to define a web 22 from which perpendicularly extend plate portions 24 and 26. "Perpendicularly," as used herein, is not intended to limit the angle between the web and the plate portions to exactly 90°. The plate portions are generally parallel to one another and the angle that they assume relative to the web may vary. It has also been found advantageous to have the plate portions diverge relative to one another so that the portion 26 is drawn down against a panel as the base member is forced into place. Plate portion 24 (See FIG. 3) is formed with a plurality of points 28 so as to afford penetration of core C of the panels and retain the base member in place. Because web 22 has a width less than the thickness of panels P, plate 26 is disposed in face-to-face contacting relationship with the rear surface of the panel when points 28 penetrate the core. In the specific embodiment shown in the drawings, plate portion 26 has a length greater than plate portion 24 so that plate portion 26 can be held flat against the rear surface of a panel during installation of the base member so as to assure proper positioning of the base member. Plate portion 26 of base member 20 includes a pair of substantially identical furcations 21 between which is defined a horizontally elongate slot 30. The furcations are deformed, such as by stamping or the like, to define marginal surface portions 32 and 34 which are spaced from the principal plane of plate portion 26 by an amount equal to the thickness of the tabs of a clip described below. The outer corners of furcations 21 are bent up as at 35 to facilitate introduction of the clip tabs into slot 30. Holes 31 in the portions of furcations 21 that lie flat against the rear panel surface accommodate staples T which may be used to assist in retaining the base member on the panels.

Marginal surface portions 32 and 34 retain a clip 36 within slot 30, the clip forming the other part of the fastener and being configured to engage the studs. Clip 36 (See FIG. 6) includes upwardly extending tab pairs 38 and 40 and oppositely extending tab pairs, one of which is seen at 42. The tabs have a thickness corresponding to the space between marginal surface portions 32 and 34, on the one hand, and the rear surface of the panel to which base member 20 is secured, on the other hand, whereby the clip can slide horizontally within slot 30. Intermediate the tabs, the clip is sized to fit within slot 30 and between the edges of marginal surface portions 32 and 34. Integral with and projecting outward from the tabs, clip 36 defines a tip 44 of limited horizontal extent from which diverge, in a direction toward the tabs, resilient wall members 46 and 48. Intermediate tip 44 and the tabs, wall portions 46 and 48 define respective re-entrant wall portions 50 and 52, which, as seen most clearly in FIG. 2, converge inward. Clip 36 is preferably formed from a single piece of resilient spring steel.

Studs 12 and 14 are of generally C-shaped configuration and include a central web 54, from opposite edges of which extend flanges 56 and 58. Because the configuration of flanges 56 and 58 is identical, only one will be described in detail. At the extremity of flange 56, remote from web 54, is a reinforcing or stiffening lip 60 which affords rigidity to the stud. Intermediate web 54 and lip 60, in the mid-region of flange 56, there is defined a planar bearing surface 62 which extends throughout the length of the stud and has a width sufficient to support the rear surfaces of two abutting panels, such as $P_2$ and $P_3$. Bearing surface 62 defines the outermost surface of the stud so as to assure co-planar alignment between panels that abut one another at the surface. Between planar surface 62 and the opposite extremities of flange 56 are two recessed surface regions 64 and 66 which are formed with a plurality of vertically elongate slots, exemplary ones of which are indicated at 68 in FIGS. 1 and 6. Because surface regions 64 and 66 are recessed inward of bearing surface 62, the edge portions thereof that define slots 68 are similarly recessed. Thus, even when clip 36 is fully engaged in slot 68, the material of which clip is constructed is stressed to provide a tight fit.

In operation, a plurality of base members 20 are installed on the edge surfaces of the panels by employment of a hammer or like striking tool. Plate member 26 of the base member has a horizontal extent greater than plate member 24, so that the former plate member 26 can be held against the rear surface of the panel to assure proper positioning of the base member during installation thereof. Because the gypsum material typically employed in wall panels has a degree of local compressibility, the web 22 of the base member can be driven flush with the edge surface of the panel if this is essential to assure proper abutting relation of adjacent panel edges. With a plurality of the base members installed as described above, clips 36 are inserted into slots 30 of the respective base members. The clearance space between margins 32, 34 and the rear surface of the panel facilitates movement of clip 36 to any desired horizontal position within slot 30. Thereafter, the clip at the upper or lower extremity of the panel edge is inserted in an appropriate stud slot 68 and the remaining clips 36 are engaged in corresponding slots, correct horizontal alignment of the clips being possible because the horizontal extent of base member slots 30 exceeds the horizontal extent of the clip tabs. The adjacent panel, e.g., panel $P_2$, is installed in a similar way and because of the movable engagement of the clips in their respective base member slots, the joint between the two panels can be closed, can be positioned in a vertical or plumb orientation, and can be positioned on bearing surface 62 to retain the exposed surfaces of the panels in co-planar relationship.

Figure 2:
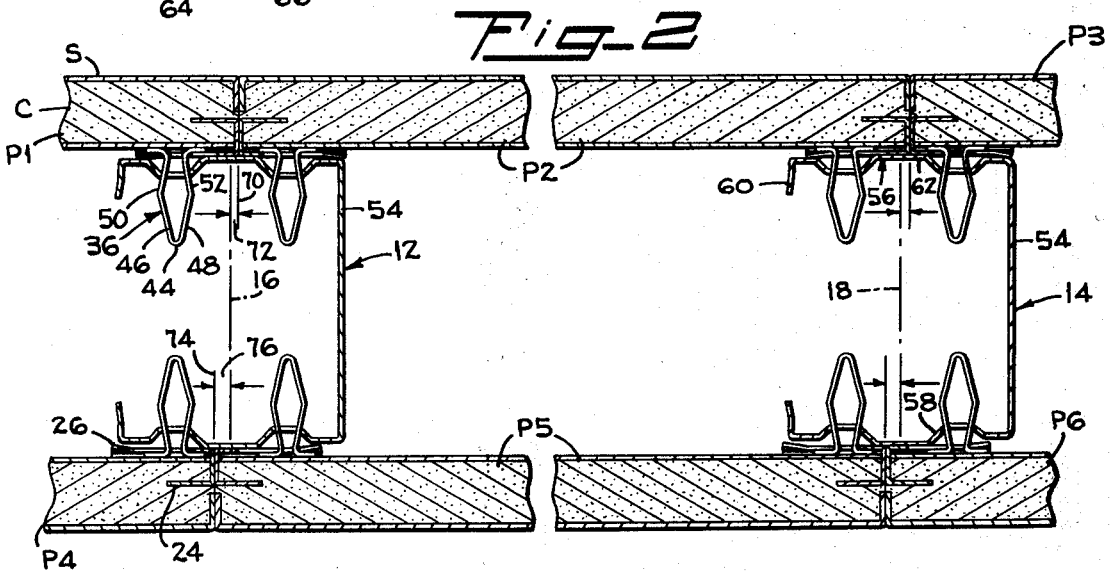
FIG. 2 is a horizontal cross-sectional view taken along the plane designated by line 2—2 of FIG. 1.
Figure 3:
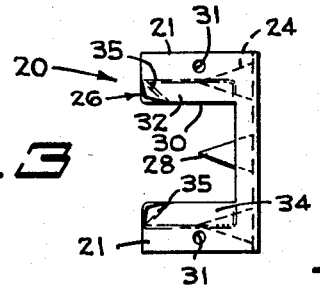
FIG. 3 is an elevation view of a base member engageable with the edge of a panel and forming a part of the fastener of the invention.
Figure 4:
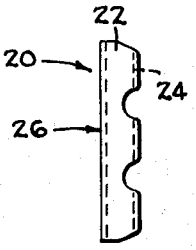
FIG. 4 is a side view of the base member of FIG. 3.

FIG. 2 indicates in more detail how the invention accommodates panels having minor variations in width. The plane at which panels $P_1$ and $P_2$ abut one another is indicated at 70, such plane being spaced from center-line 16 by a distance 72. Panels $P_4$ and $P_5$ abut one another at a plane identified 74 which is disposed on the opposite side of center-line 16 by a distance 76. Because of the horizontal extent of bearing surface 62 and because clips 36 are horizontally slidable in slots 30 of the respective base members 20, alignment and secure attachment of the panels is afforded notwithstanding minor variations in the widths of the various panels.

Figure 5:
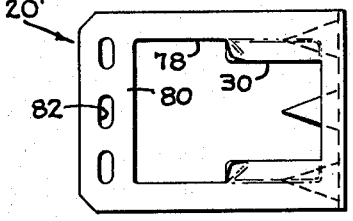
FIG. 5 is an elevation view of an alternate embodiment of the base member of FIG. 3.
Figure 5:
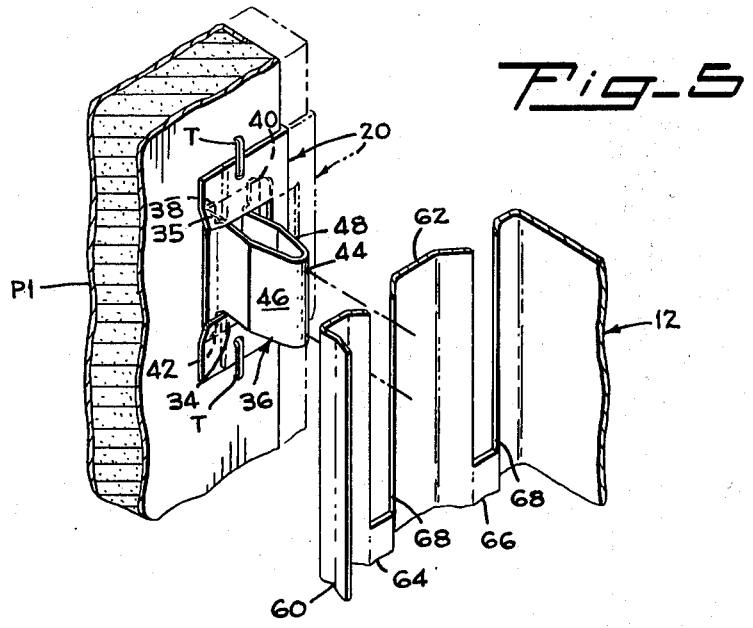

A modified form of the base member is illustrated and identified in FIG. 5 at 20′. The base member 20′ defines a slot 30′ which functions identically to slot 30 in the embodiment of FIG. 3. Outward of slot 30′ is defined a wider opening 78, which communicates with slot 30′, and outward of opening 78 is a plate portion 80 which closes opening 78 and affords an area for the formation of one or more openings 82. Opening 78 has a vertical dimension sufficiently large to afford entry of the clip tabs between the margins that define slot 30′ and the rear surface of the panel. When the plate portion of base member 20′ is installed against the rear surface of a panel, the attachment of the base member onto the panel can be made more secure by inserting one point of a staple in the panel through hole 82, the cross member of the staple straddling the part of plate portion 80 surrounding hole 82.

Figure 7:
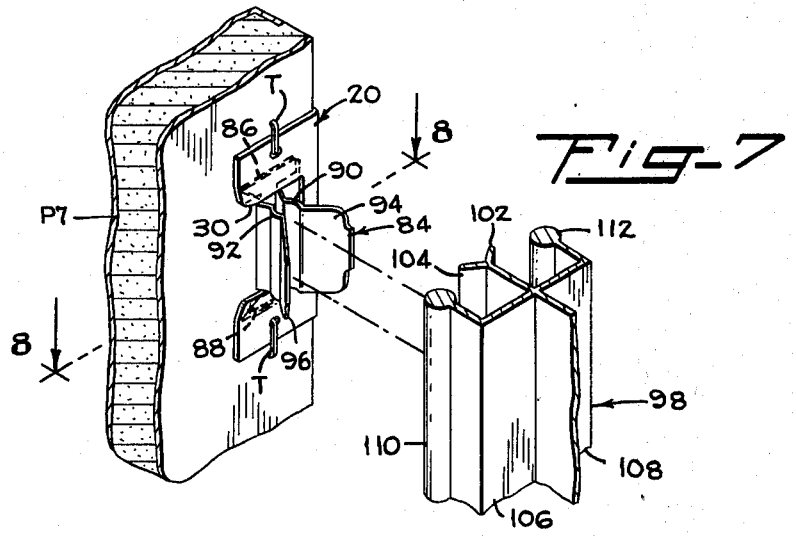
FIG. 7 is an exploded isometric view similar to FIG. 6 and showing a first alternate embodiment of the invention.
Figure 8:
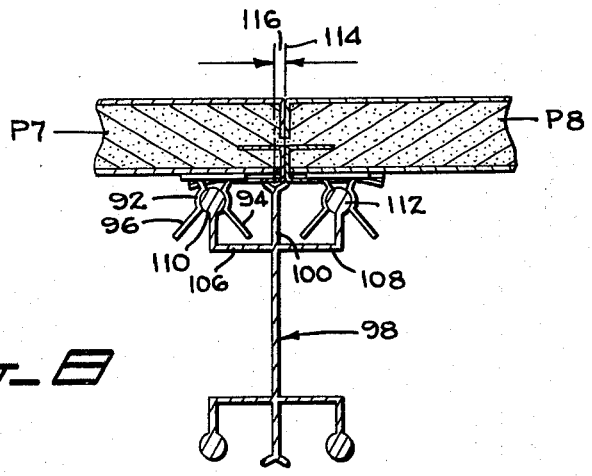
FIG. 8 is a horizontal cross-sectional view taken along the plane designated by line 8—8 of FIG. 7.

A first alternate of the present invention is shown in FIGS. 7 and 8 in conjunction with a pair of panels $P_7$ and $P_8$ identical to panels $P_1$–$P_6$. Such embodiment employs a base member 20 installed on the edges of the wall panels in the manner described hereinabove. A clip 84 is formed of resilient sheet steel or the like and has oppositely extending tabs 86 and 88 which engage the margins of base member 20 on opposite sides of horizontal slot 30. Intermediate the tabs 86 and 88 and sized to extend through slot 30, clip 84 defines opposed arcuate portions 90 and 92, from which diverge respectfully guide surfaces 94 and 96.

For cooperating with clip 84 to retain panel $P_7$ in place, there is a stud 98 which is symmetrical about a mid-plane parallel to the surfaces of panels $P_7$ and $P_8$. The stud includes a projecting flange 100 on the extremity of which are diverging plates 102 and 104 which define a generally Y-shaped configuration. The extremities of plates 102 and 104 define bearing surfaces for the rear surface of panels $P_7$ and $P_8$ so as to maintain the exposed surfaces of the panels in co-planar relationship.

Extending laterally from the opposite sides of central web 100 are L-shaped supports 106 and 108 on the extremities of which are cylindric beads 110 and 112, respectively. The radius of cylindric beads 110 and 112 is greater than the radius of curvature of arcuate clip portions 90 and 92 so that, when the clip portions are engaged on the cylindric beads, the material of which the clip is constructed is stressed thereby retaining the clip to the stud and the rear surfaces of panels $P_7$ and $P_8$ against the bearing surfaces defined by plates 102 and 104. As seen most clearly in FIG. 8, cylindrical beads 110 and 112 are inward of the bearing surfaces defined by plates 102 and 104 so that the outer surfaces of the panels are maintained in co-planar relationship by support of the inner surface of the panels against the bearing surfaces.

Because clips 84 can assume diverse positions within slot 30, minor variation in panel width can be accommodated by the structure shown in FIGS. 7 and 8. In the example illustrated, the edges of panels $P_7$ and $P_8$ that abut at 113 are shown slightly offset from the center line of stud 98 by a distance 116. This is intended to illustrate how the clips permit installation of the studs at standard intervals so that panels supported on the other side of stud 98 can be securely installed, notwithstanding variation in panel width.

Because the engagement of clip 36 in slot 68 and the engagement of clip 84 on cylindrical beads 110 and 112 is frictional, the clips can be disengaged from the studs without destroying the panels. Thus, the invention permits reuse of the panels, should the system be disassembled for the purpose of relocating a partition.

Figure 9:
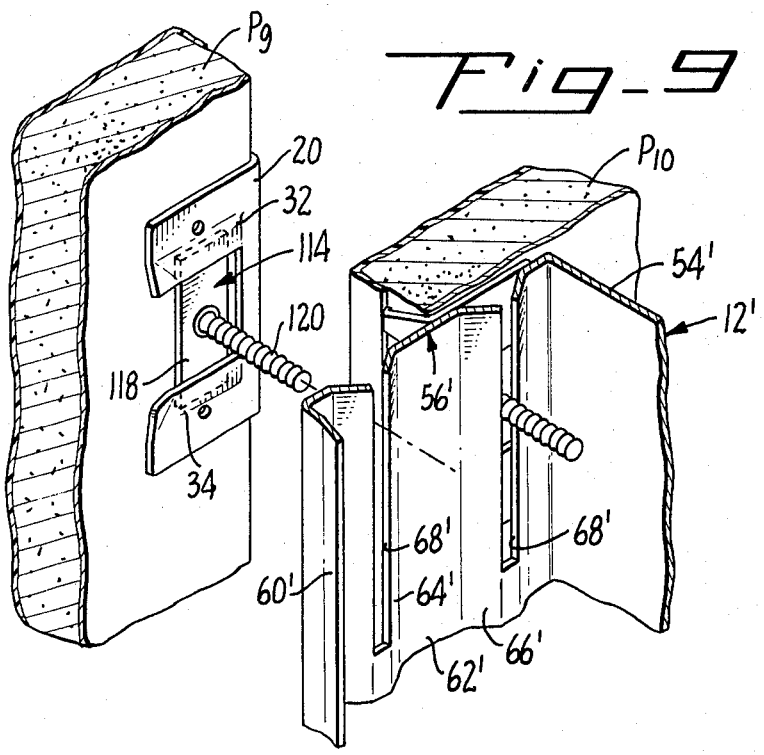
FIG. 9 is an exploded isometric view similar to FIG. 6 and showing a second alternate embodiment of the invention.

A second alternate embodiment of the present invention is illustrated in FIG. 9 in conjunction with a pair of panels $P_9$ and $P_{10}$ identical to panels $P_1$–$P_8$. This embodiment employs a base member 20 installed on the edges of the wall panels in the manner described hereinabove. It differs from the previously described embodiments primarily in the construction of the clip, designated 114, received in the base member and the construction of the stud, designated 12′.

The clip 114 comprises a planar base element 118 of generally rectangular configuration having a generally cylindrical fastener 120 fixed to and extending laterally from the central portion thereof. The distal end portions of the base element 118 are proportioned for slidable receipt beneath the marginal surface portions 32 and 34 of the base member 20 so that the clip may be slid into place and may move relative to the base member to accommodate adjustment. The fastener 120 is of "nail-like" construction and provided with a knurled outer surface to facilitate its frictional engagement with the stud 12′, as will be hereinafter described.

The stud 12′ is of the same general construction as the studs 12 and 14 and includes a central web 54′ having identical flanges extending from opposite edges thereof, one of which flanges is illustrated and designated 56′. A reinforcing lip 60′ is provided at one end of the flange 56′ and intermediate the flange a bearing surface 62′ is provided. Recessed surface regions 64′ and 66′ are provided to either side of the bearing surface 62′ and slots 68′ are formed in the recessed regions.

In operation of the alternate embodiment shown in FIG. 9, the panels $P_9$ and $P_{10}$ are secured to the stud by simply forcing the panels against the studs so that the fasteners 120 enter the slots 68′. The fasteners and slots are so proportioned that the slots are resiliently deflected as the fasteners enter and, once in place, the knurled outer surfaces of the fasteners are gripped by the edges of the slots 68′. Adjustment of the panels to accommodate slightly varying widths is provided in a manner identical to that described hereinabove with respect to the embodiment of FIGS. 1, 2 and 6. Also, as with the latter embodiment, the embodiment of FIG. 9 permits the panels to be pried off of the studs, if so desired.

Figure 10:
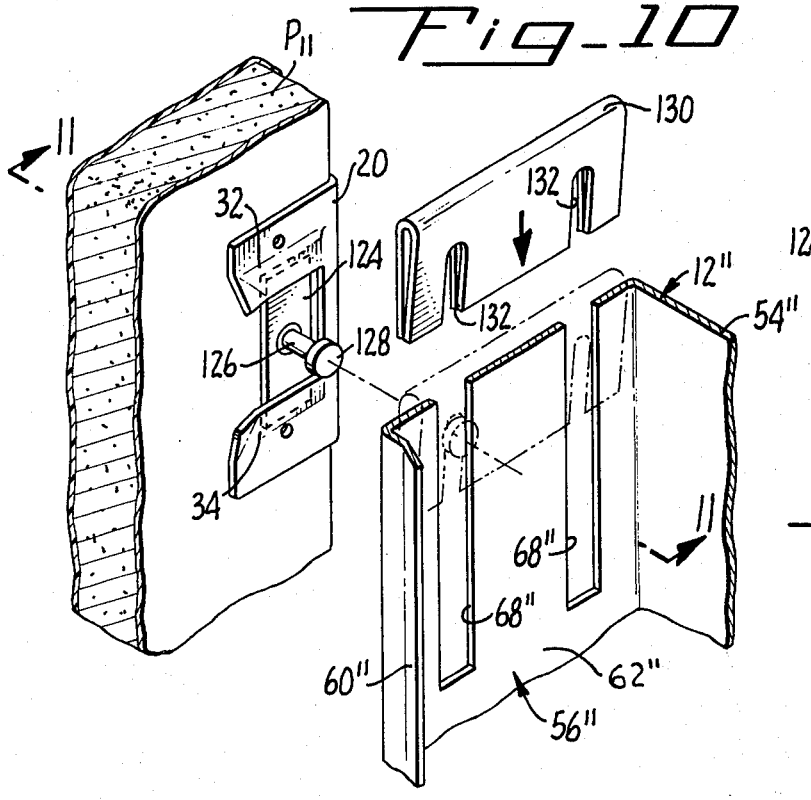
FIG. 10 is an exploded isometric view similar to FIG. 6 and showing a third alternate embodiment of the invention.
Figure 11:
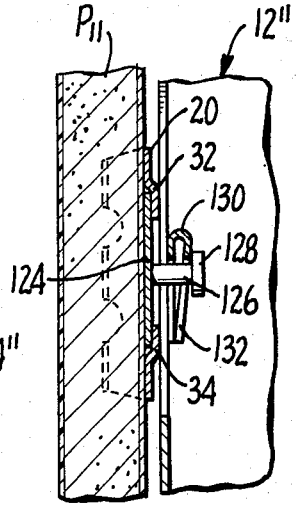
FIG. 11 is a vertical cross-sectional view taken along the plane designated by line 11—11 in FIG. 10.

A third alternate embodiment of the present invention is shown in FIGS. 10 and 11 in conjunction with a panel $P_{11}$ identical to the panels $P_1$–$P_9$ described above. Although only one panel is shown in the FIG. 10 and 11 embodiment, it should be understood that the embodiment provides for the securing of pairs of such panels in juxtaposed aligned edge-to-edge relationship.

The FIG. 10 and 11 embodiment employs a base member 20 installed on the edge of the panel $P_{11}$ in the same manner described above with respect to the other embodiments. The clip of the FIG. 10 and 11 embodiment comprises a base element 124 having a fastener 126 fixed to and extending laterally from the central portion thereof. The base element is of planar generally rectangular configuration and has distal ends proportioned for slidable receipt beneath the marginal surface portions 32 and 34 of the base member. The fastener 126 is of cylindrical configuration and provided with an enlarged head 128 at its distal end.

The stud of the FIG. 10 and 11 embodiment, designated 12″, is of a generally C-shaped configuration similar to that of the studs 12 and 14, with the exception that it is not provided with recessed surface regions, such as the regions 64 and 66. The elements of the stud 12'' corresponding to those of the stud 12 are designated by like numerals, followed by double prime (''') marks. These elements are as follows: Central web 54'', flange 56'' (the opposite flange corresponding to the flange 58 is not illustrated), lip 60'', planar bearing surface 62'', and elongate slots 68''.

The embodiment of FIG. 10 and 11 includes an element in addition to that shown in the previously described embodiments, namely, a retention clip 130. The clip 130 comprises a spring steel sheet metal member folded upon itself and having U-shaped slots 132 extending therethrough and opening through the lower edge thereof. The clip 130 is proportioned for receipt between the central web 54'' and the lip 60'' and the slots 132 are positioned for alignment for the slots 68'' when the retention clip is disposed transversely across the stud between the web 54'' and the lip 60''. As viewed from the end, as seen in FIG. 11, the retention clip is of wedge-shaped configuration.

In operation of the FIG. 10 and 11 embodiment, panels are assembled on the outsides of the studs in a manner similar to that described with respect to the previous embodiments, with the exception that the fasteners 126 initially extend loosely through the slots 68''. With a pair of panels assembled on the outside of a stud 12'' and the fasteners 126 so positioned in the slots 68, assembly is completed by sliding a retention clip 130 over the inside of the bearing surface 62'' so as to engage the slots 132 around the cylindrical portions of the fasteners and beneath the heads 128 thereof. The slots 132 are so proportioned that they slide easily around the shank of the fasteners but engage beneath the heads 128 thereof. The thickness of the retention clips relative to the length of the fasteners, and the thickness of the material of the stud 12'', is such that the retention clips pull the fasteners inwardly so as to bring the outer surfaces of the base members 20 into engagement with the opposed bearing sufaces 62''. Thus, the retention clips function to securely hold panels, such as the exemplar panel $P_{11}$, against the stud 12''.

The principal difference between the FIG. 10 and 11 embodiment and the previously described embodiments is the necessity of placing the retention clip 130 within the stud after the panels are placed against the stud. This necessitates access to the interior of the stud. Another difference is that removal of the panels from the stud requires that the retention clips 130 be first removed. Insofar as the provision of lateral adjustment to accommodate panels of slightly varying widths is concerned, the FIG. 10 and 11 embodiment functions identically to that of the previously described embodiments.

It will be seen that the present invention provides an improved panel fastening apparatus which is installed at the job site so that the panels can be economically fabricated and shipped without jeopardizing the integrity and appearance of the panels. The provision of individual and relatively small base members 20, 20' not only conserves material and labor, but permits installation of only as many fasteners as are required in a particular environment. In addition, and perhaps of most importance in the present invention, is the fact that the clips 36 and 84 are mountable within slot 30 of base member 20 at divers horizontal locations. Accordingly, minor variations in panel widths can occur without adversely affecting the strength, appearance and alignment of the resultant partition. Finally, because the system of the invention does not require that the front or decorative surface of the panels be pierced, no painting or taping is necessary and the panels can be reused.

Although several embodiments of the invention have been shown and described, it will be obvious that other adaptations and modifications can be made without departing from the true spirit and scope of the invention.

What is claimed is:

1. In combination with a wall panel of a given thickness, improved mounting apparatus therefor, comprising: a vertically extending stud having fastening means thereon for engagement by a fastener; a generally U-shaped base member defined by a planar web having a width less than the panel thickness and first and second plate portions integral with said web and extending from opposite edges of one side thereof, the side of said web opposite said one side being substantially devoid of projections, said first plate portion penetrating the edge surface of the panel to secure the base member to the panel and against movement relative thereto, with the second plate portion lying on the rear surface of the wall panel, said second plate portion defining a horizontally elongate slot bounded on two opposed sides by planar margins of said second plate portion; and a fastener having two oppositely extending co-planar tabs engaging respective said planar margins in face-to-face contacting relation intermediate said second plate portion and the rear surface of the wall panel, said co-planar tabs being slidable beneath said margins in a direction parallel thereto to afford horizontal movement of said fastener to divers positions along said slot whereby said fastener may move to accommodate horizontal movement of a panel relative to the vertically extending stud, said fastener having attachment effecting means intermediate said tabs and projecting through the slot of the base member and engaged with the fastening means of the stud.

2. In a combination according to claim 1, the improved apparatus wherein said second plate portion has an edge remote from said web, said slot extending to said edge to afford insertion of said fastener into said slot.

3. In a combination according to claim 1, the improved apparatus wherein said second plate portion has an edge remote from said web, said slot terminating inward of said edge to form an end margin intermediate said slot and said edge, said end margin having an extent sufficiently small that a staple or like fastener can be installed in the panel in straddling relation to said end margin to retain said base member on said panel.

4. In a combination according to claim 1, the improved apparatus wherein: the stud is fabricated of sheet metal and has a flange parallel to the wall panel and adapted to support the rear surface thereof; the fastening means comprises an elongate vertically extending slot within the flange; and said attachment effecting means comprises: a tip remote from said tabs sized for entry into said vertical slot; first and second resilient members diverging from said tip toward said tabs; and a re-entrant portion intermediate said tip and said tabs for engaging the portions of said stud that define said vertically extending slot to secure said fastener to said stud.

5. In a combination according to claim 3, wherein said stud includes a rib extending parallel to said vertical slot, said rib being spaced outward from the portion of said stud that defines said vertical slot so that when the rear surface of the wall panel bears against said rib said fastener is in a stressed condition in said vertical slot.

6. In a combination according to claim 1, the improved apparatus wherein: the stud includes at least one plate for defining a bearing surface for supporting the rear surface of said panel and first and second cylindrical beads rigid with said stud and disposed on opposite sides of said bearing surface; and, said attachment effecting means includes a pair of resilient walls having confronting arcuate portions that define a generally cylindric shaped space therebetween, said cylindric shaped space having a radius less than the radius of said bead, said resilient walls having diverging portions extending from said cylindric portions to form a mouth having a width in excess of said bead to facilitate engagement of said bead in said cylindric shaped space.

7. In a combination according to claim 6, wherein said cylindric beads are spaced behind said bearing surface so as to assure stress in said resilient walls when the panel supporting the fastener engages said bearing surface.

8. In a combination according to claim 1 wherein: the stud has a flange parallel to the wall panel and adapted to support the rear surface thereof, said flange defining an elongate vertically extending slot having resilient edges defining the vertical boundaries thereof; and, said attachment effecting means has a tip remote from said tabs sized for entry into said slot so as to resiliently deflect the vertical edges thereof whereby said edges function to grip the tip therebetween and resist removal of the tip from the slot.

9. In a combination according to claim 1, wherein: the stud is metal and has a flange parallel to the wall panel and adapted to support the rear surface thereof, said flange defining an elongate vertically extending slot; said attachment effecting means comprises a fastener having an enlarged distal head portion and an intermediate shank portion, both of which are proportioned for extension through said slot and a retention clip adapted to be received around the shank portion of said tip and beneath the head portion thereof so as to secure said head portion against removal through said slot.

10. A partition comprising a plurality of vertically extending studs, each said stud being disposed on a center line spaced from adjacent studs by a preselected distance, a plurality of panels having a nominal width corresponding to the distance and a given thickness, a plurality of generally U-shaped sheet steel base members, each said base member being defined by a central web and first and second plate portions extending from one side of the web in spaced, generally parallel, relationship to one another, the side of the web opposite said one side being substantially devoid of projections, said web having a width less than the given thickness, the first plate portion of each of said base members penetrating the edge of a panel whereby said base members are secured to said panels and against movement relative thereto with the second plate portions thereof lying along the rear surfaces of the panels and defining horizontally elongate slots bounded by margins of said plate portions, a clip associated with each said base member, each said clip having oppositely extending tabs engaged beneath the margins of the second plate portion of the base member associated therewith and connecting means intermediate said tabs and projecting through the slot of said second plate portion for effecting connection to one of said studs, each said clip being horizontally slidable in the slot associated therewith during positioning of the panels on the studs so as to effect alignment of said connecting means with said stud, whereby said connecting means can be engaged notwithstanding minor variations in widths of said panels.

11. A partition, according to claim 10, wherein said studs each include means defining a bearing surface and means cooperable with said connecting means for effecting engagement between said connecting means and said studs, said bearing surface extending beyond said engagement effecting means and having a horizontal extent sufficient to bear against the rear surfaces of two abutting panels to retain said panels in co-planar relationship.

* * * * *